United States Patent [19]

Nagin

[11] 3,956,788

[45] May 18, 1976

[54] BRIDGE FLOOR AND METHOD OF CONSTRUCTING SAME

[76] Inventor: Harry S. Nagin, 5000 Boardwalk, Apt. 1512, Ventnor, N.J. 08406

[22] Filed: Oct. 23, 1974

[21] Appl. No.: 517,088

[52] U.S. Cl. ..... 14/73; 52/664

[51] Int. Cl.[2] ..... E01D 19/12

[58] Field of Search ..... 14/73; 52/667, 664, 52/669, 177, 181

[56] References Cited

UNITED STATES PATENTS

| | | | |
|---|---|---|---|
| 596,773 | 1/1898 | Guillaume | 52/667 X |
| 1,665,846 | 4/1928 | Denni | 52/181 |
| 1,736,968 | 11/1929 | Goertz | 52/667 X |
| 1,977,299 | 10/1934 | Bates | 52/669 X |
| 2,162,742 | 6/1939 | Nagin | 14/73 |
| 2,190,214 | 2/1940 | Nagin | 52/669 |
| 2,846,931 | 8/1958 | Priest | 52/667 |
| 3,110,049 | 11/1963 | Nagin | 14/73 |
| 3,156,168 | 11/1964 | Nagin | 52/177 X |
| 3,156,456 | 11/1964 | Menough | 52/667 X |
| 3,577,862 | 5/1971 | Cerutti | 52/669 X |
| 3,783,471 | 1/1974 | McGeary | 52/181 X |

*Primary Examiner*—Nile C. Byers, Jr.

*Attorney, Agent, or Firm*—Parmelee, Miller, Welsh & Kratz

[57] ABSTRACT

This invention is for a light-weight bridge floor and the like in which spaced parallel structural sections with top flanges and vertical webs are connected by cross braces threaded through openings punched through the webs of the structural sections at intervals along their lengths and at a level spaced below the top flanges of said sections and thereafter deformed in such manner that the cross braces cannot move relatively to the webs through which they pass and integrate the structure whereby loads are distributed from one structural section to the others and welding is unnecessary. Subsequently deck strips with skid-resistant surfaces are applied lengthwise over the flanges of the structural sections which are wider than the tops of the sections to such strips being wide enough to cover a single section, or of a width to cover a plurality of sections. The assembly may be made in situ on the bridge structure or preferably prefabricated in transportable panel sections.

20 Claims, 22 Drawing Figures

BRIDGE FLOOR AND METHOD OF CONSTRUCTING SAME

This invention relates to floor structures for bridges and like elevated traffic-bearing structures and the method of manufacturing them, and is designed to combine light weight in a bridge floor with the elimination of some sources of failure which reduce the life of bridge floors as now constructed much below their expected useful life.

BACKGROUND

A bridge must be constructed not only to sustain its own weight, including the floor, commonly referred to as "dead load," but also the weight and impact of traffic, referred to as the "live load." It is important to the bridge designer that the dead load be reduced as much as possible without impairing its capacity to safely carry the live load. Much study has been given to the construction of bridge floors since they contribute to such a large part of the entire dead load of the bridge, and also because they are directly subject to the wear and deteriorating impact of traffic. In addition, the floors are exposed to the elements and the corrosive effect of air-borne pollution. Also, in large areas of the nation they are exposed to the destructive effect of snow-melting and de-icing chemicals.

When a bridge floor must be replaced, not only is it costly, but it will usually seriously disrupt the flow of traffic across it for extended periods of time.

Open grid floors for bridges have the lowest weight per square foot of flooring heretofore used. They have welded joints at the intersection of the cross bars and bearer bars, and in many cases apparently sound welds are in fact imperfect with the result that after a period of time under severe traffic conditions bars not infrequently become increasingly loose, noisy, and eventually the grating must be replaced. This is especially true where the welding usually imparts a bow to a grating panel which is subsequently flattened by rolling, tending to excessively stress the welds. While they are in service, open grid floors do have the advantage that wind pressures above and below the deck are equalized, which is especially desirable on long bridge spans where unequal wind pressures above and below the bridge floor produce destructive forces. Whether filled with concrete, or used as an open grid, such grid structures have nevertheless heretofore provided one of the best available floors.

SHORT DESCRIPTION OF THE INVENTION

According to the present invention a bridge floor or like structure is comprised of spaced parallel structural metal sections sometimes herein referred to as bearer bars, typically I-beams, with flanged tops and a vertical web, and cross-braces threaded through aligned openings through the webs of the structural sections at intervals therealong and at a spaced distance below the top flanges and so deformed in the spaces between the webs of the structural section that they thereafter are interlocked against relative movement between the structural sections as to integrate the system of structural sections and cross-braces, and weld failures inherent in welded gratings are eliminated. The cross-braces comprise inverted metal angle sections with the apexes at the top and sides or legs of the bar section diverging downwardly. Subsequently non-slip strips forming the bridge deck are applied to extend lengthwise over the tops of the structural sections. In some instances these strips are individually applied to the tops of the several structural sections and extend beyond the flanges thereof, thereby narrowing the width of the open spaces between the tops of the parallel structural sections, and in some cases these strips may be of a width to extend across the tops of two or more structural sections, in which case the open spaces are closed except perhaps for small openings that may be provided in these wider strips.

The cross-braces are spaced well below the tops of the structural sections and the deck strips so that they are never directly contacted by the traffic moving over the bridge, including broken anti-skid tire chains on vehicle wheels. In fact with this construction the surface of both the bearer-bars as well as the cross-braces are protected from direct contact of vehicle wheels as well as are the cross-braces so that they are preserved while the deck strips which are directly exposed to traffic and weather may be replaced from time to time with little inconvenience to traffic.

The invention may be fabricated in situ on the bridge structure, but preferably is comprised of panels placed end-to-end and/or side-by-side, these panels being of a size which can be prefabricated at a place of manufacture and transported to the bridge structure to be then secured in place. The manufacture of panels is the presently-preferred procedure and their construction and the process of forming them are hereafter described in detail.

The invention further contemplates that on certain lanes or walkways of the bridge, the spaces between the tread strips above described may be filled with inverted channel sections of relatively light gauge metal so that such lanes may be safely used by bicycles, motorcycles, and pedestrians, including persons wearing high-heeled or narrow shoes.

BRIEF DESCRIPTION OF THE DRAWINGS

With the foregoing general explanation, my invention and the preferred manner of practicing the same may be more fully explained and understood by reference to the accompanying drawings, in which.

It has been heretofore explained that the floor structure herein provided comprises spaced parallel bearer bars in the form of structural metal sections with a flanged top and vertical webs with brace sections passing transversely through the webs of a group of several such bars, the braces being metal angle sections with the apexes at the top and the two sides of these sections diverging downwardly from the apex, and that the portions of the cross-braces between adjacent webs of the structural sections and at the ends of the braces are deformed after the assembly is made so as to thereafter permanently fix the braces against movement and integrate the parts into a fixed unitary structure. This can be accomplished by arranging the parallel sections or bearer-bars, with openings punched through the webs in spaced parallel relation on the bridge structure and threading the brace sections through the openings and then deforming them in the location in which they are used, but preferably the floor structure will be comprised of panels of predetermined length and width and the construction of these panels and their assembly is particularly described herein.

THE PANEL CONSTRUCTION

Figure 1:
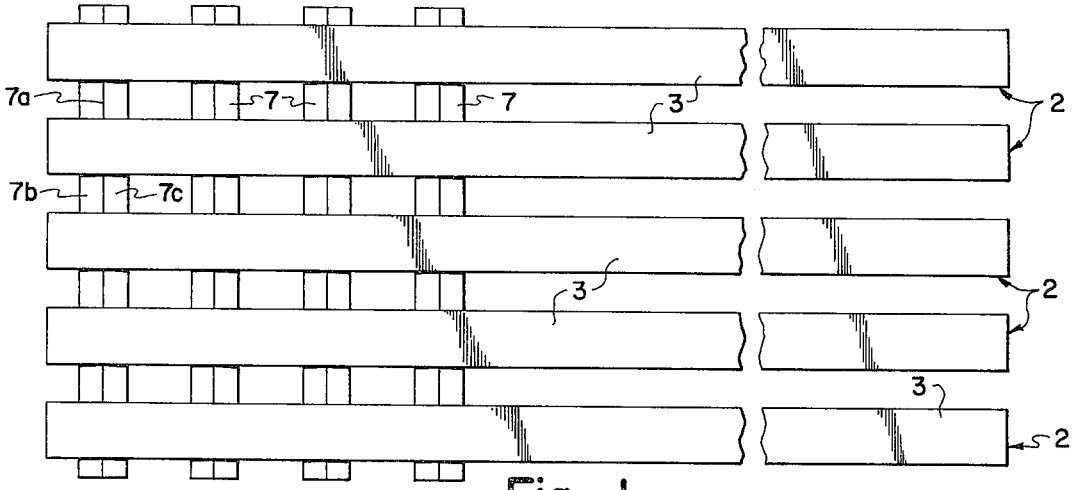
FIG. 1 is an illustrative plan view showing an assembly of several longitudinal bearing bars which are structural I-beams arranged in parallel relation with a number of angle bars passing therethrough, although the assembly as here shown is not complete.
Figure 3:
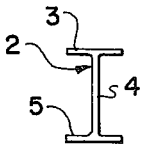
FIG. 3 is an end view of the bearer bar shown in FIG. 2.

Referring to FIG. 1, the spaced parallel structural sections are here shown as beams 2, each of which has a flat top flange 3, a vertical web 4, and a flanged bottom 5, the sections in this view being a conventional form of I-beam, one of which is shown in detail in FIG. 3. The sections are spaced from one another so that cooperating dies as hereinafter described, or other tools, can enter between them and deform the brace members, also hereinafter described. For example the top surface of each beam 2 may typically but not necessarily be 4 inches wide and the intervening spaces between also four inches or less, but to accommodate a deforming tool as hereinafter described, not substantially less than two inches. The depth of the beams will depend on the length of the panel between the supports and on which they are carried and the load which they are intended to carry.

Figure 2:
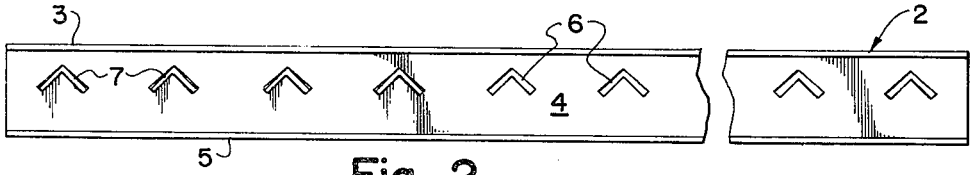
FIG. 2 is a side elevation of one of the bearer bars, but with many of the cross-braces not yet in place in the openings in order to show an arrangement of the openings punched at intervals through the web of the bar along its length.

As shown in FIG. 2, the web of each beam has slotted inverted generally V-shaped openings 6 punched through the web below the top flanges and above the bottom flanges, desirably the greater portion of each opening being above the neutral axis of the beam and with the apexes of the slots spaced below the flanges of the I-beams a definite distance, perhaps at least about an inch below. The slots in one beam are in transverse alignment with similar slots in the other beams in the assembly, so that brace members 7 may be threaded through the beams at regular intervals, as seen in FIG. 1.

Figure 4:
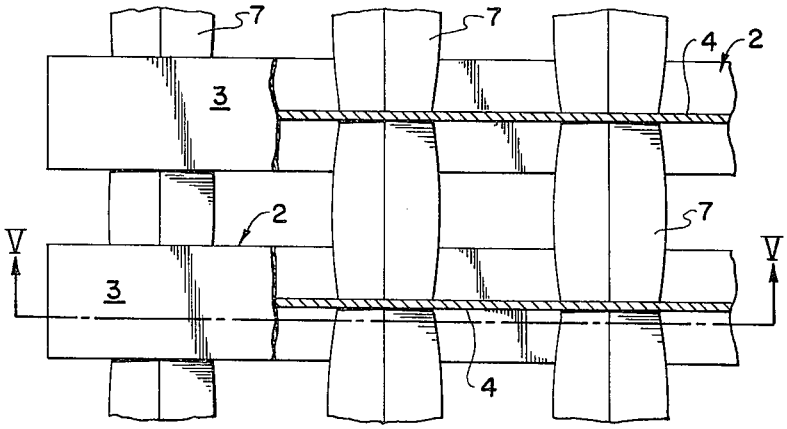
FIG. 4 is a fragmentary view, partly in top plan and partly in section of a finished portion of a structural panel on a larger scale than FIGS. 1 and 2.
Figure 5:
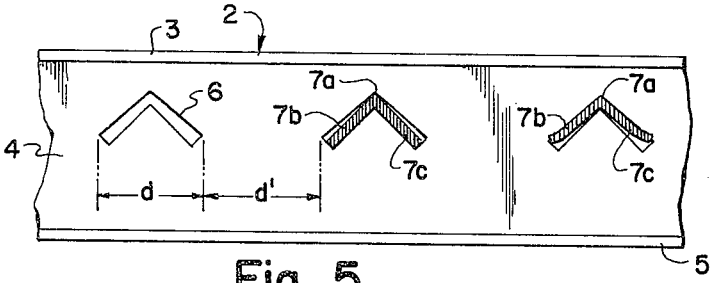
FIG. 5 is a vertical longitudinal section in the plane of line V—V of FIG. 4.

Preferably the brace members 7 are angle-shaped bars with the two sides or legs at right angles to each other and with the apex 7*a* at the top, the two legs 7*b* and 7*c* diverging downwardly (FIGS. 4 and 5). I presently contemplate that these angles will be 3 inches on a side, that is 3 × 3/16 inch sections, so that the spread between the two edges, i.e., dimension *d* in FIG. 5 is about 4.41 inches and the distance *d'* is about the same. These dimensions are referred to merely as showing that the inverted angle sections comprising the braces or brace-members can be on relatively close centers but with a substantially solid web to connect the top and bottom of each I-beam between the openings. In some cases, moreover, the braces may be more acute or more obtuse than right angle sections. Instead of using standard hot rolled angles, I may use lighter angles formed for the purpose from flat strip stock.

Figure 5A:
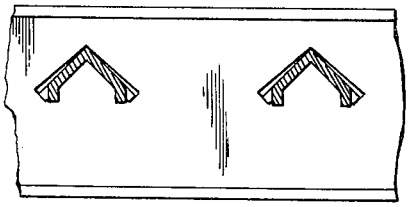
FIG. 5*a* is a view similar to FIG. 5 but with the inverted angles constituting the cross-braces having the extremities of the divergent legs squeezed into parallelism instead of spread as in FIGS. 4 and 5.

To facilitate the insertion of the angle bars through the slots in the webs and to secure a better structure, the slots at the apex are here shown as having a dimension just sufficient for the part of the bar near and including the apex to slide through it with a close fit while the widths of the slots increases on a taper toward the lower ends of the slots so that the lower ends of the slots are roughly slightly greater than twice the thickness of the metal of which the angle is formed. With openings of this shape the cross bars will easily pass through the aligned slots in the webs of the structural sections of the panel assembly. However my invention does not exclude slots of a size and shape to closely fit completely about the angle bars. After the panel is assembled, the inverted angle sections are deformed by either spreading the edges of the divergent legs outwardly between each two bearer bars, and similarly deforming the projecting ends of the bars (see FIG. 5) or alternatively the edges of the angle bars are squeezed toward each other (see FIG. 5*a*) so that once this has been done these bars cannot move relatively to the bearer bars and then constitute braces that unite and integrate the assembly into a unitary structure in which welds at the intersections are unnecessary, and which serve to distribute loads on one bearer bar to the others in the panels. At the same time, since the braces do not direftly receive the impact of traffic, they have less tendency to work loose.

Since no welds are necessary, an important advantage of this construction is that aluminum sections may be used in whole or in part in developing the bridge floor.

THE METHOD OF DEFORMING THE BRACES

Figure 6:
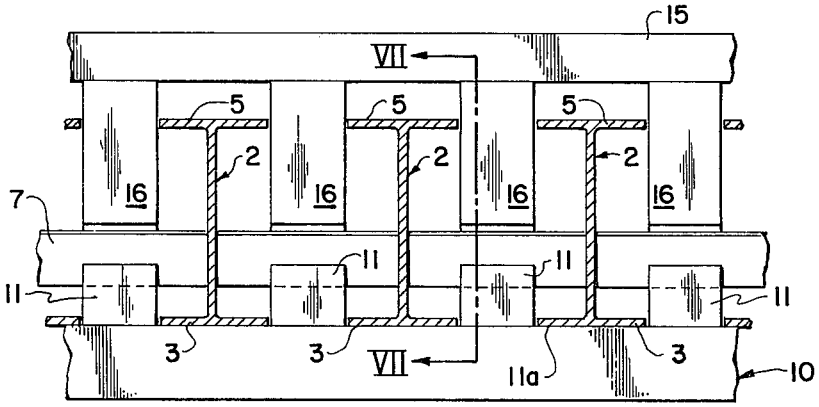
FIG. 6 is a fragmentary section of a portion of the assembly in FIG. 1, but on a larger scale and for purposes hereinafter described, with the assembly inverted, the assembly being supported on a lower multiple cavity female die with a multiple element male die positioned above the cross bar and above the female die with the parts in position to close and deform the brace bars.
Figure 7:
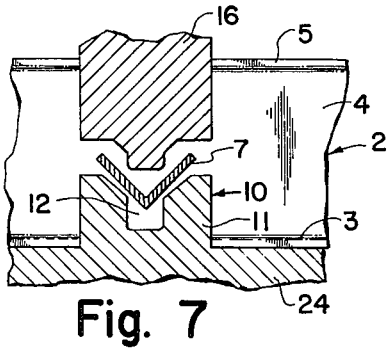
FIG. 7 is a fragmentary transverse sectional view in the plane of line VII—VII of FIG. 6, only two sets of dies and two cross-braces being shown.

For purposes of illustration, FIGS. 1 and 2 show the brace-forming members or angle bars in the upright position as they are with the finished panel in use and in which they would be if panels were made in situ on the bridge, but in making the panel in a fabricating shop I prefer that the panel be assembled with the top side down and the operation of deforming the brace members be effected while the assembly is in this position. This is shown in FIGS. 6 and 7 where 10 indicates a jig and multiple female die having upright projections 11 spaced to have a working fit between the flange 3 of the inverted beams 2. Between the projections are recesses 11*a* into which the flanged tops 3 of the inverted bearer-bars are received and the bars held parallel while the brace members are inserted. Each projection 11 comprises a female die element with a cavity 12 which is also a guide and support for the brace member 7 as it is threaded through the webs of the bearer bars, as shown in FIG. 7.

The combined jig and die 10 may be large enough for engaging one brace member at a time, but it may and desirably does have an area and die elements sufficient to enable an entire panel of perhaps twelve feet in length and six feet in width to be assembled thereon at one time. However it is important that each brace member be simultaneously deformed between all intersections and at the ends, whether the die is designed to engage one angle section at a time or a plurality of them.

There is a complementary multiple element male die structure 15 above the inverted panel assembly as shown in FIG. 6. It has a male die element 16 at spaced intervals therealong, each one of which is designed to cooperate with a female die element 12 in the projections 11. The die 10 sets on a support or press platen, not shown, and the die 15 is on a press head, not shown, both the platen and head comprising parts of a power-operated press of any preferred or known structure. Preferably, the press with platens so arranged is a hydraulic press.

Figure 8:
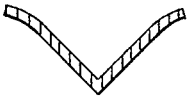
FIG. 8 is a typical section through a brace from the assembly of which it is a part and after it has been deformed by the dies of FIG. 6, the section being substantially in the plane of line VII—VII of FIG. 3.

When the panel has been assembled, or a portion of it assembled in the combined jig and die unit 10, with the angle-bars passing through the webs of the bearer bars, the upper die 15 is lowered so that each male die element 16 extends between two bearer bars and is centered over the angle bar, as seen in FIGS. 6 and 7. As the press continues to close, the initial effect is to first start to force the legs of the angle bars 7 in each reach between intersections and at the ends toward each other and then spread them apart at some point intermediate their ends toward the free edges of the legs. The forces which tend to close the angle of the V in the first part of the closing of the dies will cause the metal at each side of the dies to also fold in, or it may cause it to spring apart, but in either case there is an initial distortion of each portion of the angle sections that extend between the webs of one bearer bar and the next and also at the ends of the angle bars, the greatest distortion occurring between the dies but extending to a decreasing extent, as shown in FIG. 4, toward the I-beams. With dies as shown in FIG. 7 the edges of the brace members will flare outwardly to about the shape shown in FIGS. 5 and 8, but with a different shape of dies the brace members may take the shape shown in FIG. 5*a*.

If the two die structures are the full area of the panel, a single operation of the press will complete the panel. However, if this is not the case, the assembly will be advanced in increments of one or more brace members until deformation of all of them has been accomplished. In any case, however, all portions to be deformed of each angle bar are simultaneously engaged whether a single brace member is engaged between the dies or more than a single brace member at a time. When all of the angle sections have been thus deformed the panel is removed from the dies and turned over. FIG. 4 shows generally how the brace members bulge adjacent each web on each side of the web so that the brace members are interlocked with the structural sections and cannot thereafter move endwise.

The deformation of the angle bars imparts a permanent set, and the design of dies is best accomplished by performing the assembly operation with the assembly inverted as described, but as previously suggested, this is not an essential, though highly desirable procedure. It is particularly desirable since it forces the apexes of the angle bars tightly against the tops of the slots in the bearer bar webs in which they are received and the distortion of the bearer bars assures their remaining that way. This is important for reasons hereinafter pointed out. The sides or legs of the angle bars should slope downwardly and outwardly in the finished panel so that they will not tend to hold moisture or dirt, and should be sufficiently below the top flanges 3 that they can in no case be contacted by wheels of vehicles. For clarity of illustration FIG. 5 shows a section of a bearer bar with the slot at the left open, the one at the center has the brace member or angle section in place, while the one at the right shows the angle section deformed into a completed brace.

Figure 10:
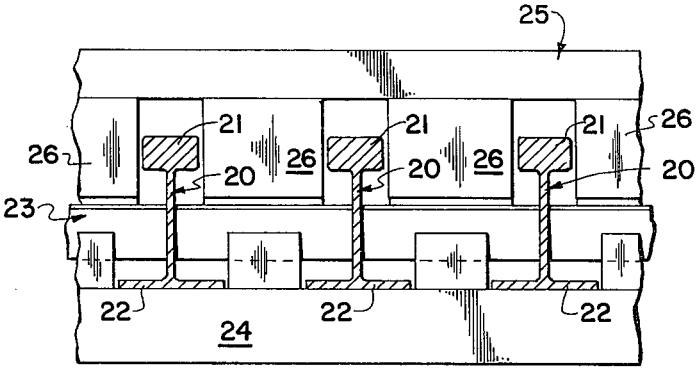
FIG. 10 is a view similar to FIG. 6 of a modified construction wherein only the tops of the I-beams, here inverted, have lateral flanges while the bottoms are thicker and less wide than the tops, but have about the same amount of metal as the top flanges.

Instead of using as the bearer bars a symmetrical section where the flanges at the top and bottom are the same, sections such as shown in FIG. 10 may be used. Remembering that this view also shows the bearer bars inverted, as in FIG. 6, the tops of the bearer bars are flanged, as in FIG. 6 but the bottom has a thicker head or base portion containing the same weight of metal as do the sections previously described, but the lateral projection of the flanges is much less. In this view 20 designates the bearer bars, with the bottoms 21 turned up and comprising a thickened head or base while the tops 22 are flanged. An angle section to be deformed is indicated at 23, and 24 is the lower, multiple-cavity die member, and 25 is the upper multiple die member with positive die elements 26 projecting down between the bottoms 21 of each two inverted bearer bars. Because of the narrower bases of the bearer bars in this modification, the die elements 26, corresponding to 16 in FIG. 6, can be made much longer than the corresponding elements in FIG. 6. This enables the cross braces to be more effectively spread closer to the webs of the bearer bars than with the assembly shown in FIG. 6.

Figure 9:
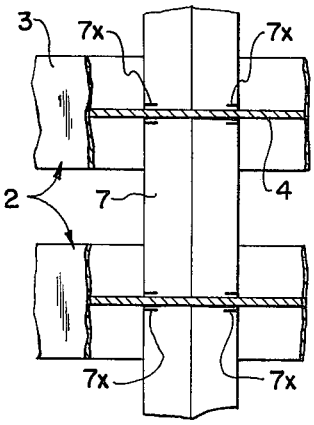
FIG. 9 is a fragmentary plan view partly in elevation and partly in section where the legs of the inverted angles constituting the braces are slit a short distance in from the edges each side of the web of the bearer bars to facilitate the distortion of the legs adjacent the webs and insure a more effective interlock.

Normally, if the spring is made of steel the I-beams may be formed from a higher carbon steel than the cross braces, and in addition the cross braces will be of a section thinner than the webs of the I-beams so that they can be cold-pressed to effect the desired deformation. However to assure adequate deformation of the angle bars against the sides of the bearer bar webs, the cross bars, particularly if they are of heavier section or higher carbon steel, and have short kerfs or slits precut therein at locations where the slits will be at each side of the web of each bearer bar, as shown in FIG. 9. In this view the webs 4 of two cross bars 2 are indicated in section with only the top flanges removed. The cross bar 7 has slits or kerfs 7*x* extending a short distance inwardly toward the apex from one or both edges, so located that there will be such slits close against each side of the webs of the bearer bars. For purpose of illustration the drawings indicate these kerfs further removed from the webs of the I-beams than would normally be the case.

To facilitate the deformation of the bars where they may be too resistant to effective cold deformation they may be heated, with or without slitting as shown in FIG. 9. This may be readily accomplished, for example, by connecting the opposing male and female die element to opposite terminals of a source of electric current so that heat is generated at the interfaces of the dies and the angle bars, as is now done in the manufacture of pressure-welded gratings, but only to a temperature where the cross bars will deform more readily under pressure—not to welding temperature.

Figure 19:
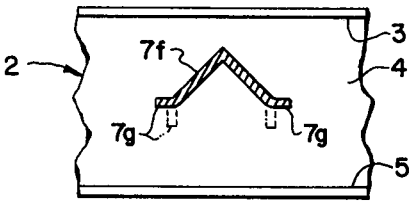
FIG. 19 is a transverse fragmentary section showing a brace of modified form wherein each free edge of the sides of the angle have lateral lips that may be bent down or up to effect the desired deformation.
Figure 20:
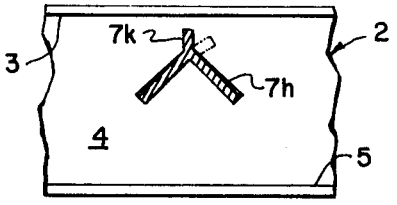
FIG. 20 is a view similar to FIG. 19 showing a deformable ridge at the apex of the brace-bar which may be bent over to lock the bar in place.

While I have specifically described usual angle sections and deforming them by spreading or squeezing their edges, many sections having downwardly-diverging legs may be substituted. For example, in FIG. 19, there is shown an angle bar 7*f* with lips 7*g* extending from each edge. These lips may be deformed, as by bending them down to the dotted line position as indicated in this figure. In FIG. 20 there is shown an angle section 7*h* with a lengthwise fin 7*k* along the top, and this fin may be bent over to the dotted line position in lieu of or in conjunction with deformation of the edges, or of flanges as shown in FIG. 19.

One skilled in the art will appreciate that under load, the surface of the cross braces where they pass through the I-beam webs being closely fitted in the openings in these webs, the cross braces constantly resist deflection of the I-beams and actually strengthen the I-beams so that the removal of metal from the webs of the I-beams to receive the cross braces does not weaken the structure in any way.

The Deck

Figure 11:
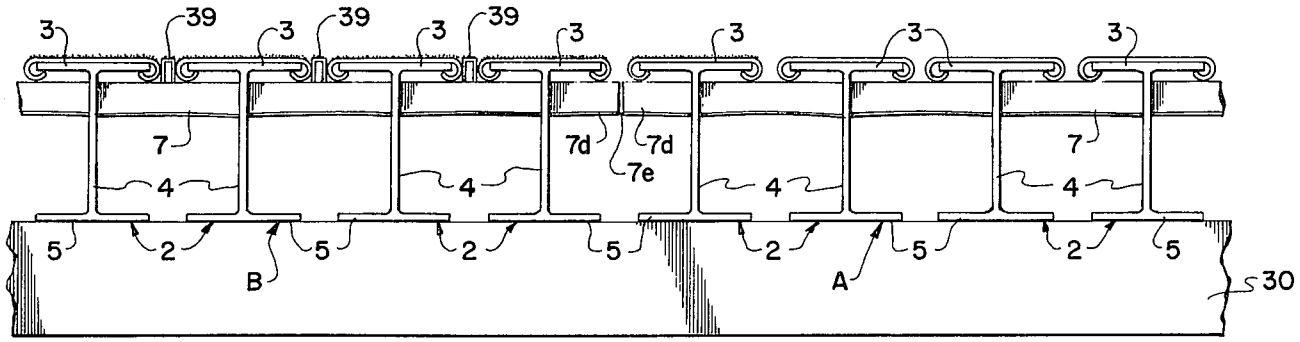
FIG. 11 is a fragmentary transverse section through a bridge floor showing adjacent panels with one form of floor or deck strips applied thereto and with added inserts between the strips of one panel such as would be provided for bicycle and motorcycle traffic and even for pedestrian use.

FIG. 11 shows a transverse section through portions of two adjoining panels and illustrates a preferred form of bridge floor or deck embodying this invention. As previously indicated, the bridge floor is comprised of spaced parallel I-beams, which if formed from prefabricated panels, is constituted of several panels placed end-to-end and side-by-side, with the I-beams, that is the bearer bars, usually, but not always running lengthwise. Typically the structural panels as heretofore described may be twelve feet long and six feet wide, this being a convenient size for handling, but often there may be panels of less width, for example two or three feet wide for catwalks or sidewalks, and they may be longer and wider. FIG. 11 shows only a small fragment of the entire floor, since the showing of an entire floor would reduce the elements to such small size as to conceal the construction.

In FIG. 11, 30 designates a floor beam or structural section forming part of the bridge for supporting the floor and similar sections extend under the floor at spaced intervals along the length of the bridge. A portion of one of the two side-by-side panels is designated A and a portion of another panel section alongside the first is designated B. The I-beams, as in the other figures, are designated generally as 2; 3 are the top flanges of the I-beams, and 4 are the webs and 5 the bottom flanges. The cross braces of deformed inverted angle section are designated 7, as in other figures, and 7*d* shows how the ends of the cross braces of the two sections confront each other at 7*e* so that, if desired, they can be joined by splice plates or angle sections, not shown.

Figure 18:
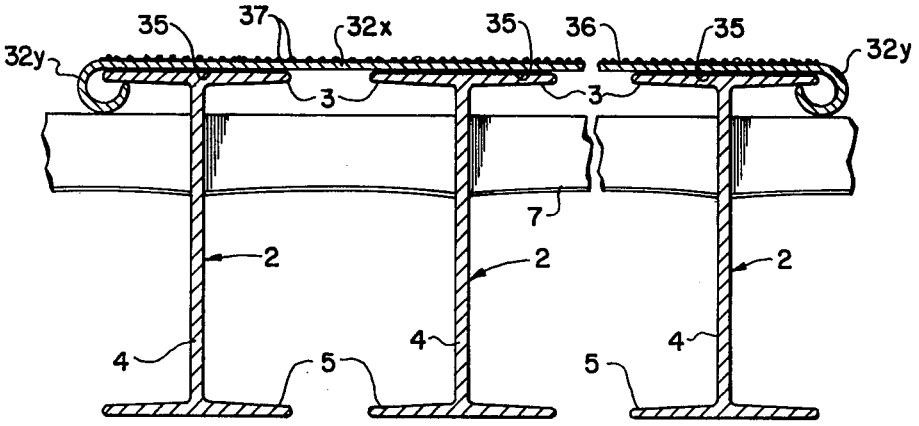
FIG. 18 is a section through a group of I-beams with a single deck strip spanning the entire group.

There are sheet metal wear plates or deck plates or strips 31 sometimes or a width to cover only one I-beam, and sometimes of a width to span two or more I-beams. Each strip has a flat top 32 wider than the top of the beam to which it is applied. The edge of each strip 31 is turned downward at 32' to bear on the cross members 7 and to curl under the flanges of an I-beam as indicated at 33 so that it cannot lift vertically from the I-beam. These downwardly and inwardly-curled opposite edges are in fact wedged between the tops of the cross braces and the undersides of the beam flanges to keep them tight and free of rattle, particularly when combined with the plastic or resin as hereinafter described. If the strip 32*x*, FIG. 18, is wide enough to span two or more I-beams, then the inwardly-curled edges 32*y* of the strip extend under the two most remote or most separated left and right or oppositely-turned I-beam flanges of the plurality of sections which the strip spans.

These strips, as here disclosed, are applied to the I-beams of a prefabricated panel before the panel is permanently in place on the bridge structure, but after the panel has been otherwise completed, since these plates narrow the space between the edges of the strips to an extent where effective deformation of the cross bars 7 cannot be performed by opposing dies. Usually they are applied by sliding them over the flanges of the I-beams at the place where the panels are assembled, but they can be applied either on new floors or as replacement strips on the I-beams after they are in place. If the deck strips are formed of steel, they are completely galvanized, but if they are aluminum galvanizing is, of course, not used, but in any case the top and bottom of the strips is primed or surface-treated to effect the bonding of a resinous coating thereto. Thereafter an enduring weather-resistant coating 36 of resinous material, preferably a polyurethane having a high coefficient of friction is applied over the top or outer surface of the deck strip and cured in situ on the strip.

Desirably there is a sprinkling of anti-slip grains 37 adhesively bonded to or embedded in said coating. Typical granular materials for this purpose comprise silicon carbide or aluminum oxide, either alone or combined with white sand or pigment to reduce heat absorbtion from the sun.

A layer of primer and a resinous elastomer, also of polyurethane is desirably applied to the top flanges of the structural beam sections and cured in situ. This layer has a high friction quality and if the deck strips are put in place by sliding them endwise over the tops of the beams this is done before the resin has completely cured, or with the use of a temporary lubricant. The strips can of course be put in other ways, as by springing them on or forcing the downwardly-extending curled edges under the flanges after the strips are in place.

Figure 12:
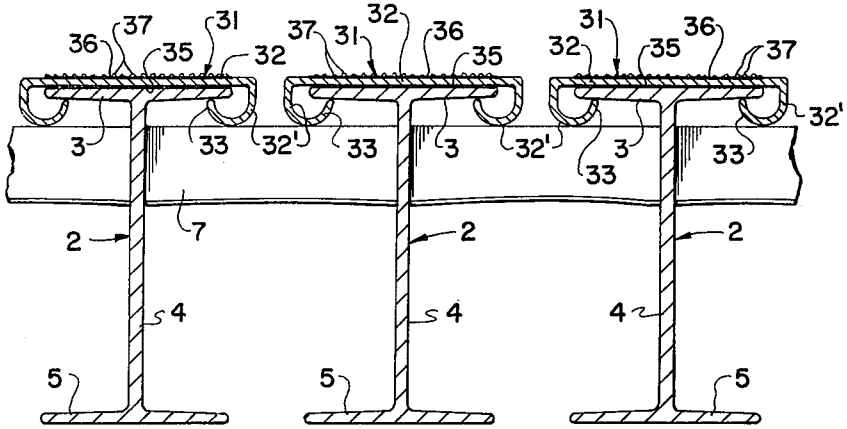
FIG. 12 is a fragmentary view on a larger scale similar to FIG. 10 but showing only three bearer bars of the panel assembly.

The intervening layers between the strips and the beams are indicated at 35 in FIGS. 12 and 18 and provide a cushion and sound-absorbing medium between the deck strips and the structural assembly.

Once the panel with the deck strips thereover is in place on the bridge floor, it is ordinarily not removed because as wear of the surface covering occurs, new coating material and abrasive grains can be sprayed or spread over the strips and will air-cure in a short time and at relatively low cost, a cost which is greatly offset by the lighter structure of the bridge which this floor permits, and the elimination of high initial cost of concrete and its subsequent deterioration as herein previously mentioned.

Figure 21:
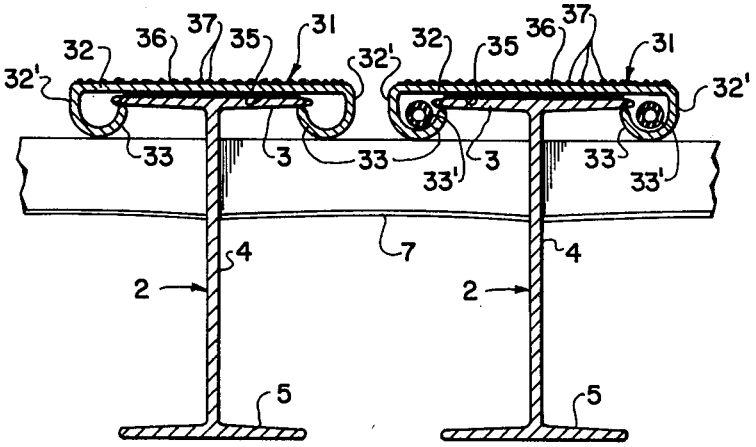
FIG. 21 is a fragmentary view similar to a portion of FIG. 12 but with the top of the deck strip somewhat wider than in FIG. 12.

Because of the open spacing between the parallel deck strips, differences in air pressure above and below the bridge floor is equalized or reduced to an unimportant degree, but importantly the upflow of air as the top of the bridge heats up under exposure to the sun has an important cooling effect. As shown in FIG. 21, the deck strips may be somewhat wider than the tops of the I-beams, thereby reducing the width of the open spaces, even to less than one inch. Since the structure is otherwise the same as in FIG. 12, for example, similar reference numerals indicate corresponding parts.

Where the deck strips are of a width to cover a plurality of structural sections, they may be perforated to provide drainage therethrough as well as air passages through the deck.

Since ice formation on bridges usually occurs sooner than on other portions of the highway due to a slight difference in the surface temperature of the bridge which does not have the benefit of the earth beneath it, this may be avoided, particularly in hazardous areas by running a heating element, either an insulated resistance wire or a continuous tube, such as a rubber tube 33' (FIG. 21) through the curled edges of the cover strips or selected ones of them through which even mildly-heated anti-freeze liquid may be forced to at least keep the bridge temperature close to the adjacent highway temperature or even higher, perhaps high enough in many cases to prevent icing which might otherwise occur.

Figure 13:
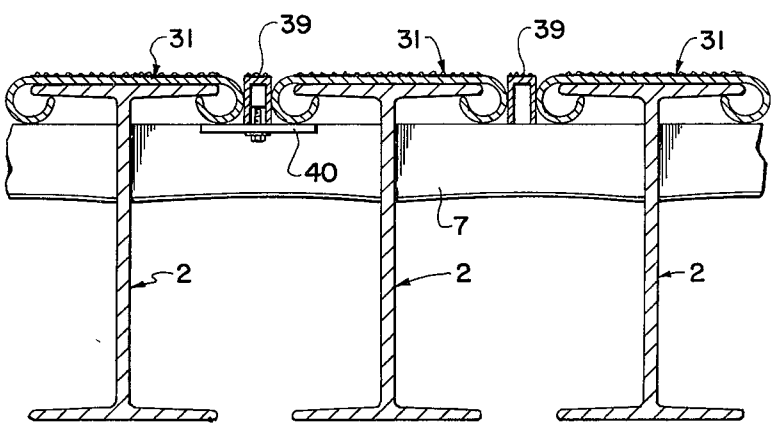
FIG. 13 is a view similar to FIG. 12 but showing in addition the insert strips for use where bicycle and other narrow-wheeled vehicles will travel.

While the continuous lengthwise spaces between the deck strips is not undesirable for motor vehicles, and may even be desirable in reducing side sway of vehicles or sidewise skidding, it is not a desirable surface for narrow-wheeled traffic such as bicycles, perhaps motorcycles, and in some cases, horseback riders and horse-drawn vehicles. Wherever this is a consideration one or parallel lanes may be formed as shown in Section B of FIG. 11 and in FIG. 13 where the floor, similar to that shown in FIG. 12, has narrow inverted channel sections 39 fitted snugly between the main deck strips 31, these being supported by the cross-members 7. They are, of course, substantially coextensive in length with the strips 31 and may be anchored or held against removal in various ways, for example by cross members 40 (see FIG. 13) secured by a threaded stud and nut depending from the section 39 so as to extend crosswise under the overhanging edges of the strips 31 and lie close against the cross bar 7 so as to also resist endwise movement of the bars 39, but which may be rotated to lie parallel with the length of the inserts 39 for insertion or removal.

Figure 14:
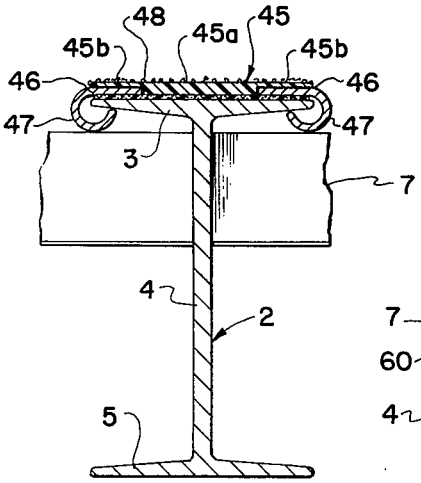
FIG. 14 is a fragmentary transverse section through the panel showing but a single bearer bar and with a modified form of floor or deck strip.

Instead of forming the deck strips provided in the manner just described, I may employ an arrangement such as shown in FIG. 14 where there is a strip 45 of plastic material, such as a dense polyurethane having a high coefficient of friction. It has a thick center portion **45*a* and thinner marginal extensions 45*b*. As shown in FIG. 14 the marginal extensions 45*b* are uppermost and the lower surface of the plastic strip is cemented to the top 3 of the I-beam section 2 so that the marginal extensions are spaced above the top 3 of the I-beam. There are sheet metal edge strips 46, each with its outer edge 47 turned downwardly to rest on the cross bars 7 and then turned upwardly against the under surface of the I-beam flanges, providing in effect an elongated "clip" that is wedged onto the edge of the I-beam flange. This strip has also been coated with primer, if it is not galvanized, and then with a polyurethane film and the top, which fits under one of the marginal extensions, may be cemented in place, or held in place by reason of its high coefficient of friction. If necessary this surface may be removed and replaced. In this view the upper surface of the strip 45 has abrasive grains and/or white sand 48** adhered thereto, a tough, nonbrittle polyurethane compound being preferably used for this purpose.

In some cases the strip 45 may be turned over so that its marginal portions as well as its center are flat against the top of the I-beam and the upper margins of the clips 46–47 overlap the margins of the center strip 45. While I refer to the members 46–47 as clips, they will normally be coextensive in length with the lengths of the I-beams. The composite assembly thus constructed for each I-beam of a panel may replace the unitary construction shown in FIGS. 11, 12 and 13, and can be forcibly removed and replaced with similar pieces assembled in situ.

Figure 15:
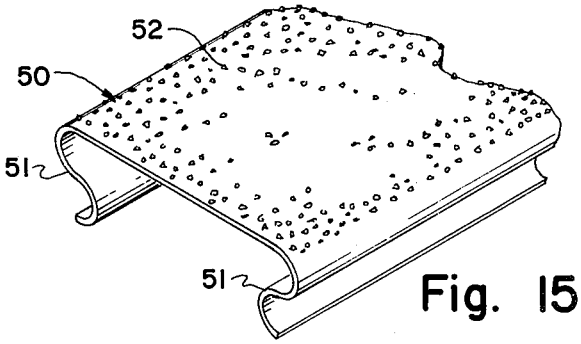
FIG. 15 is a perspective view of a snap-on joining strip for use in bridging the joint between the ends of the deck strips of abutting panels.

Frequently when panels are disposed in end-to-end relation in a complete floor assembly, or when I-beam sections are placed end-to-end in assembling the floor elements in situ, there may be a slight space between the ends of the deck strips of one panel and those of the next. In this case a joint cover, as shown in FIG. 15, may be used. It comprises a simple sheet metal strip with downwardly-extending reversely-curved flanges, bowing outwardly, then inwardly and then outwardly. The strip is designated 50, the depending reversely-curved edges 51, and desirably it is primed or galvanized and coated with polyurethane or other resistant coating as previously described. The abrasive coated flat top surface, as previously described on the tread strips themselves, is designated 52. The sides of this connector and its dimensions are such that it may be placed over the two confronting ends of deck tread strips of end-to-end panels and pressed down to spring tightly into place. Polyurethane or other air-curing adhesive may be used if desired to prevent subsequent removal.

Figure 16:
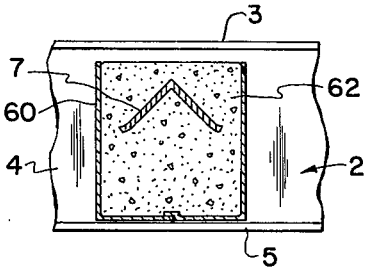
FIG. 16 is a transverse section through one brace showing one manner of providing a concrete bracing block between parallel beams, particularly between the confronting ends of two cross-braces where a joint or splice will ordinarily be used.
Figure 17:
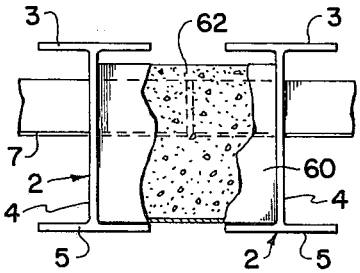
FIG. 17 is a side elevation partly in section of the form and concrete bracing block shown in FIG. 16.

Finally, in the structural panels themselves, but more especially where panels are in side-by-side relation and where the bridge or other elevated structure may be subjected to considerable lateral force, as for example hurricane force winds may be anticipated, special reinforcements may be desirable between panels and sometimes even between parallel bearer sections of individual panels. Where this condition is expected, U-shaped metal forms 60, perhaps made in reversed L-shaped sections as shown in FIG. 16 are placed between the abutting ends, usually spliced, of the brace bars of two panel assemblies so as to enclose the abutting ends of cross bars of two side-by-side panels, as at *7e* in FIG. 11. This form is then filled with a special concrete or cement composition to form a solid block 62 of relatively small dimensions, but of high stress resistance and heavy moments of pressure to integrate adjacent panels. These can be used between confronting ends of all of the braces, but they may often be desired at spaced intervals. The special concrete so used is exceptionally strong, a preparation known as an epoxy concrete being preferable. This preparation has high tensile strength and will resist compressive forces of the order of 10,000 lbs. p.s.i. and it will adhere to the metal cross braces so that it is particularly effective. Such material may also sometimes be used around the spans of the cross braces between I-beams of the same panel or elsewhere where there is no splice.

I have referred to polyurethanes as being particularly preferred as a covering and adhesive material. This is because they provide wide latitudes in the achievable properties suitable for my purpose. These polymers made from polyisocyanates usually with polyether or polyester polyols are well known to those skilled in the art to which they relate, and can be formulated to cure under a variety of time and temperature conditions and to produce within reason almost any required physical or mechanical properties, degrees of adhesion, softness or hardness, and, particularly important, with an unusually high degree of wear-resistance. Generally they should, to at least some degree, be an elastomer and to be unaffected by thermal changes to which the parts to which they are applied are subject. They should dry, set or cure as conditions may require. Specifically, I have selected products of Hughson Chemicals, Lord Corp. of Erie, Pa., grades M 312 and M 412 which are two-part elastomeric coatings. The primers, whether the metal has a normal steel surface or is aluminum, comprise a modified polyvinyl-butyral coating containing phosphoric acid catalyst.

However, other materials than polyurethane possessing to a considerable extent the same properties may be substituted, as perhaps conventional rubber-based adhesives and flexibilized epoxy and polyester resins.

There are many important advantages of the invention. Among these is the important fact that without welds, either in the structural panels or the deck structure, aluminum may be substituted in whole or in part for steel. Also because there are no welds or other rigidly fixed connections either between the elements of the panel and the deck strips, there is a flexibility which will take care of even major traffic conditions, but provides a quieter and easier riding quality. Also not only can the coated surface on the deck be easily applied after wear has taken place, but the deck strips after becoming worn can be replaced due to limited resilience that permits them to be removed with special tools and replaced by others. Hence the load-carrying beams need not become worn or lose strength from wear, and the braces are at a level where they are below contact with the traffic over the floor and do not receive the direct thrust or drag of wheels moving or stopping on the bridge. Of great importance also is the fact that the I-beam sections in the panels can span longer distance, thus eliminating closely-spaced stringers necessary with highway bridge floors presently in common use.

Important, too, is the protection of the supporting panels from weather and air-borne and other pollution. The deck strips, covering as they do the I-beams and being wider than the I-beams, shed rain water and snow water with any absorbed, dissolved or entrained pollutants entirely clear of the tops of the I-beams, and most of the full height of the I-beams and water which may fall onto the braces flows down and off the sloping sides with not more than insignificant amounts reaching the places where the cross braces and I-beam webs intersect, and even these places can quickly dry out. The deck covering strips as herein described can be used because of the cross braces being far enough below the tops of the I-beams to provide clearance for the curled edges of the strips to rest on the cross braces and engage the undersides of the flanges. Even after the panels are completely assembled, as well as before, and also before complete assembly, the resinous material or like material can be sprayed onto the cross braces at each side of each web through which they pass to seal any crevices between the cross braces and the webs of the structural beams against moisture and pollutants creeping into the intersections.

As hereinbefore explained, the structural panels themselves are completely integrated structures where the bearer bars and brace members function effectively in such manner that loads tending to deflect one or two bearing bars are transmitted laterally to all of the other bearing bars in the structure, be it a prefabricated panel or a structure assembled in situ. Incidentally where the structure is assembled partly or completely in situ, different means are used to deform the brace sections either by downward pressure tending to slightly flatten them, or by opposed movable jaw devices insertable in the spaces between the bearer bars and constituting no part of this invention.

I claim:

1. A bridge floor and like structure supported on floor-supporting members in the bridge structure comprising:

a. spaced parallel structural sections each having a flanged top and a vertical web below the top, b. cross brace members passing through the webs of the several structural sections at intervals along their length at a level where the cross brace members are spaced below the flanges at the tops of said sections where they are clear of any traffic moving over the structural sections, said bracing members holding the structural section is fixed spaced relation and constituting load-distributing members, and c. deck strips extending lengthwise of the structural sections of a width in a range greater than the width of the flanged top of a single structural section up to a width sufficient to span a plurality of sections, the deck strips having downwardly and inwardly-curled edges that extend according to the width of the strip under the opposite edges of at least one structural section up to the remotest oppositely-extending edges of the plurality of structural sections which they span, the inwardly-curled edges having clearance below the top flange of the structural section and the tops of the said bracing members.

2. The invention defined in claim 1 wherein there is a resinous cushioning layer between the tops of the structural sections and the under surface of the deck strips.

3. The invention defined in claim 1 in which there is an anti-slip resin coating over the upper surface of the deck strips.

4. The invention defined in claim 3 in which the resin is an elastomeric resin.

5. A bridge floor as defined in claim 4 in which the resin has abrasive grains bonded thereto.

6. The invention defined in claim 1 in which there is an elastomeric resinous cushioning means between the tops of the structural sections and the under surface of the deck strips and wherein there is an anti-skid resinous coating over the top surface of said strips.

7. The invention defined in claim 1 in which the downwardly and inwardly-curled edges of the deck strips are wedged between the under surfaces of the flanges of the structural sections.

8. The invention defined in claim 1 in which the deck strips of a width to cover a single structural section extend beyond flanges of the structural section sufficiently to effectively reduce the open space between the flanges of adjacent structural sections and thereby enlarge the traffic-bearing surface of the floor.

9. The invention defined in claim 8 where adjacent structural sections have inverted channel-like insert strips with their top surfaces flush with the deck surfaces of said strips secured in the open spaces between the deck strips to substantially close said spaces.

10. A bridge floor as described in claim 9 in which both the deck strips and the inserts have an anti-skid surface comprised of an elastomeric resin coating selected from the resins consisting of polyurethane, rubber-based adhesives and flexibilized epoxy and polyester resins.

11. The invention deined in claim 8 wherein heating elements extending lengthwise of the deck strips are enclosed in the curled edges of some of the deck strips.

12. The invention defined in claim 1 wherein the deck strips span a plurality of structural sections and only their remote side edges are downwardly and inwardly-turned so as to engage oppositely-turned flanges of the uppermost structural sections so spanned.

13. The invention defined in claim 1 in which the bracing members are mechanically interlocked with the respective webs of the several structural sections.

14. The invention defined in claim 1 in which the cross brace members are inverted angle sections with the sides of the angle sections diverging downwardly and the apexes uppermost, the webs of the several structural sections having aligned slots therein of a size and shape conforming substantially to the original shape of said cross brace members, portions of said cross brace members between adjacent webs being deformed to prevent endwise movement of the brace members relative to the webs of the sections.

15. The invention defined in claim 14 in which the opposite ends of the cross brace members are similarly deformed.

16. The invention defined in claim 14 in which the cross brace members are closely fitted in the openings in the webs of the structural sections through which they pass to reinforce the structural sections against deflection.

17. A bridge floor and like structure comprising structural panels supported side-by-side and end-to-end on the bridge structure, each panel:

a. comprising a plurality of parallel spaced structural sections each with a flanged top and a vertical web, b. cross-braces passing through the webs of the several structural sections below the flanges at the tops of the sections and above the bottoms, which cross-braces are angle bars with the apexes of the angles being uppermost and the legs diverging downwardly from the apexes, the webs of the several structural sections having openings therethrough of a shape to snugly fit the angle bars and confine them against vertical movement relative to the structural sections or in a direction transverse to the lengths of the angle bars, c. selected edge portions of each angle bar between each two structural sections being deformed by bending their opposite lower edge portions in opposite directions so that the cross-sectional shape of the bars where they pass through the structural sections is substantially unchanged but the portions between the bars cannot thereafter move relatively to the structural sections but the overall length of the bars after such deformation is unchanged from the original length, and d. a deck surface supported by the panels.

18. The method defined in claim 17 in which transverse slits are formed in the edge portions of at least one side of each angle section immediately adjacent the sides of the webs to facilitate deformation of the edge portions and provide an abutment that will further prevent relative movement between a cross brace and the beam.

19. In a bridge floor and the like comprised of structural panels supported in abutting end-to-end relation on floor-supporting members of the bridge structure wherein:

a. each panel comprises a plurality of spaced, parallel structural beams with vertical webs and flanged tops, cross-bracing passing through the webs of the structural beams below the flanged tops, the cross-braces being angle sections threaded through openings in the webs of the beams of similar shape to the angle sections, the angle sections in those portions between each two vertical webs being deformed from their original shape to prevent relative movement between the cross-braces and the beams, b. deck strips covering the tops of the beams substantially coextensive in length with the beams and of a width greater than the beams with the edges of the strips curled under the flanges of the beams on which they are placed to secure the strip to the tops of the beams, and c. connecting tread strips over the confronting ends of the tread strips comprising flat strips with reversely-curved downwardly-extending flanges along each side, which flanges resiliently spring over the inwardly-curled edges of the tread strips and interlock therewith.

20. A bridge floor and the like comprised of structural panels supported in end-to-end and side-by-side relation wherein:

a. each panel comprises a plurality of spaced, parallel structural beams with vertical webs and flanged tops, cross-bracing at intervals along the length of the beams which pass through the webs of the beam sections below the flanged tops thereof, the cross-braces being angle sections threaded through openings in the webs of the beams of a shape and size for the cross-braces to pass therethrough, the cross-braces having those portions thereof between the webs of adjacent beams deformed to interlock the cross-braces and beams in fixed relation to each other, the opposite ends of the vross-braces projecting beyond the webs of the two outermost beams of the panel, b. the cross-braces of one panel having said projecting ends in confronting relation to at least some of the ends of another panel positioned alongside thereof, and c. a block of high tensile, high compressive strength resin bonded concrete surrounding the said confronting ends of at least some of the cross-braces and extending between the full width of the space between the webs of the adjacent panels from which the confronting ends project.

* * * * *